United States Patent [19]

Skupien

[11] Patent Number: 4,696,175

[45] Date of Patent: Sep. 29, 1987

[54] CLUTCH APPARATUS FOR SPRING MAKING MACHINE

[76] Inventor: Eugene M. Skupien, 66 S. Vista Ave., Addison, Ill. 60101

[21] Appl. No.: 857,243

[22] Filed: Apr. 29, 1986

[51] Int. Cl.[4] ..... B21F 3/02

[52] U.S. Cl. ..... 72/135

[58] Field of Search ..... 72/129, 130, 131, 132, 72/135, 137, 138, 142, 145; 140/71 R, 103; 226/188

[56] References Cited

U.S. PATENT DOCUMENTS

| | | | |
|---|---|---|---|
| 1,065,336 | 6/1913 | Bigelow . | |
| 1,083,223 | 12/1913 | Sleeper . | |
| 2,324,641 | 7/1943 | Peterson | 72/132 |
| 2,923,343 | 2/1960 | Franks | 72/131 X |
| 2,939,492 | 6/1960 | Lewis, III et al. | 140/71 |
| 3,010,491 | 11/1961 | Pearson | 72/132 |
| 3,194,282 | 7/1965 | Bergevin et al. | 140/103 |
| 3,230,985 | 1/1966 | Kaufmann | 140/103 |
| 3,351,101 | 11/1967 | Halvorsen et al. | 140/1 |
| 3,563,283 | 2/1971 | Tufektshiev et al. | 140/71 |
| 4,026,135 | 5/1977 | Yagusic et al. | 72/142 X |
| 4,173,135 | 11/1979 | Lamperti | 72/131 X |
| 4,211,100 | 7/1980 | Sykes | 72/131 |
| 4,289,004 | 9/1981 | Itaya | 72/7 |
| 4,393,678 | 7/1983 | Favot et al. | 72/131 |
| 4,416,135 | 11/1983 | Russell | 72/131 X |

FOREIGN PATENT DOCUMENTS

| | | | |
|---|---|---|---|
| 421417 | 3/1974 | U.S.S.R. | 72/132 |
| 565761 | 7/1977 | U.S.S.R. | 72/138 |

OTHER PUBLICATIONS

CNC Coil Former/Multi Coil Former Brochure, Okuno Machine Tool, Osaka, Japan (Undated).

Brochure entitled, "Advanced Duplex Wire Working Machines for Torsion Spring and Wire Form Production", Sleeper & Hartley Corp., Worcester, Mass.

Brochure entitled, "Computerized Extension Spring Making Machines", Itaya Engineering Ltd. (Comtech of Farmington Hills, Michigan) (Undated).

*Primary Examiner*—E. Michael Combs

[57] ABSTRACT

An improved clutch apparatus for a spring forming machine is disclosed having two independently-operating, one-way clutches (i.e., one left hand and one right hand clutch) which commonly drive a pair of wire feed rollers through connecting gears such that 360° of machine use is provided. That is, while one clutch is operating to feed wire, the other clutch is in a return mode such that both clutches constantly reciprocate in a sequential manner thereby permitting continuous wire feeding and forming. Due to the common gear connection, the associated dual feed rollers are operated by whichever clutch is in the drive mode at a given time. The dual clutches are advantageously placed adjacent the front of the wire forming machine away from the planetary gearing system, so as to allow convenient access to the interior of the spring forming machine for maintenance and set-up purposes, as well as to provide the operator with room to add additional forming equipment to accommodate any particular wire forming application as required. Separate cam-actuated rack gears are provided to drive the dual one-way clutches. Alternative eccentric slide type feed drive apparatus for driving the clutches is also disclosed.

8 Claims, 11 Drawing Figures

FIG. 7
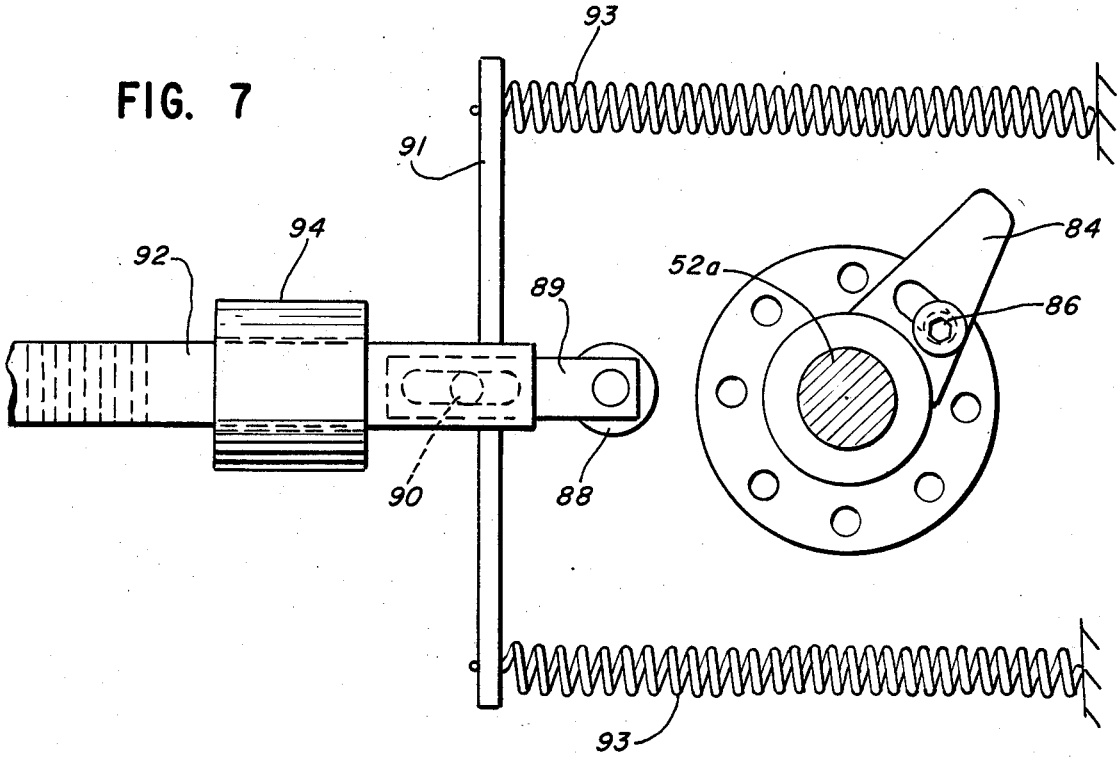
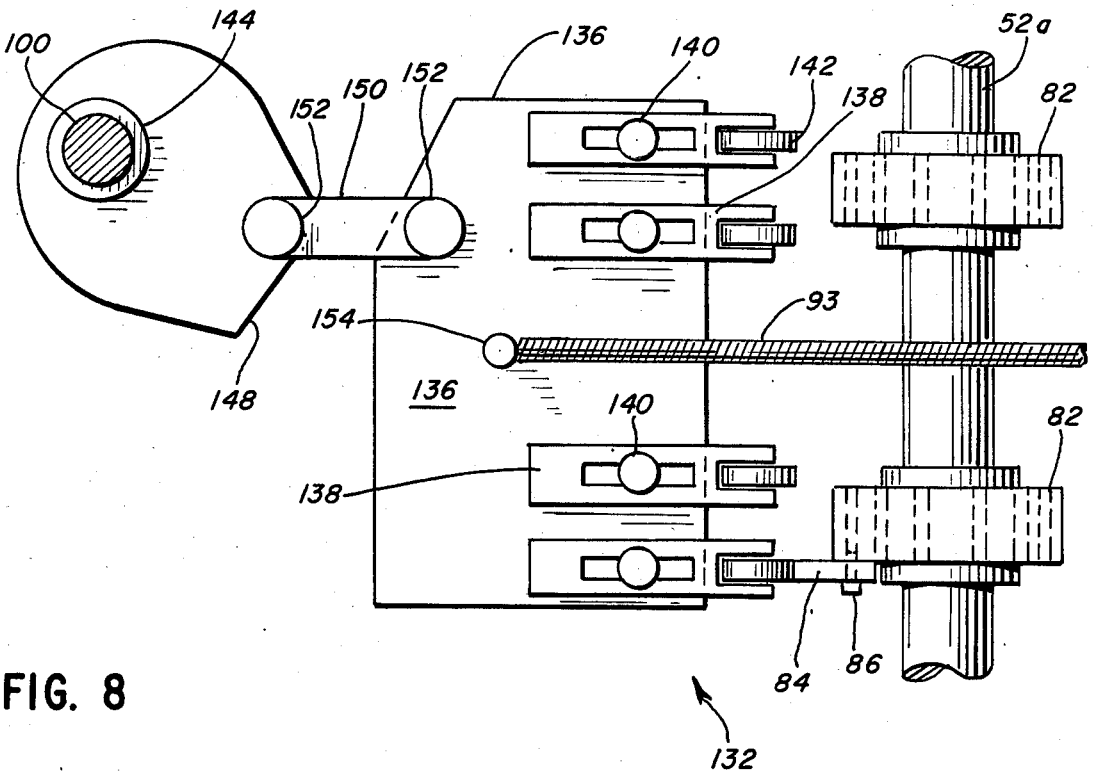
FIG. 8

FIG. 9
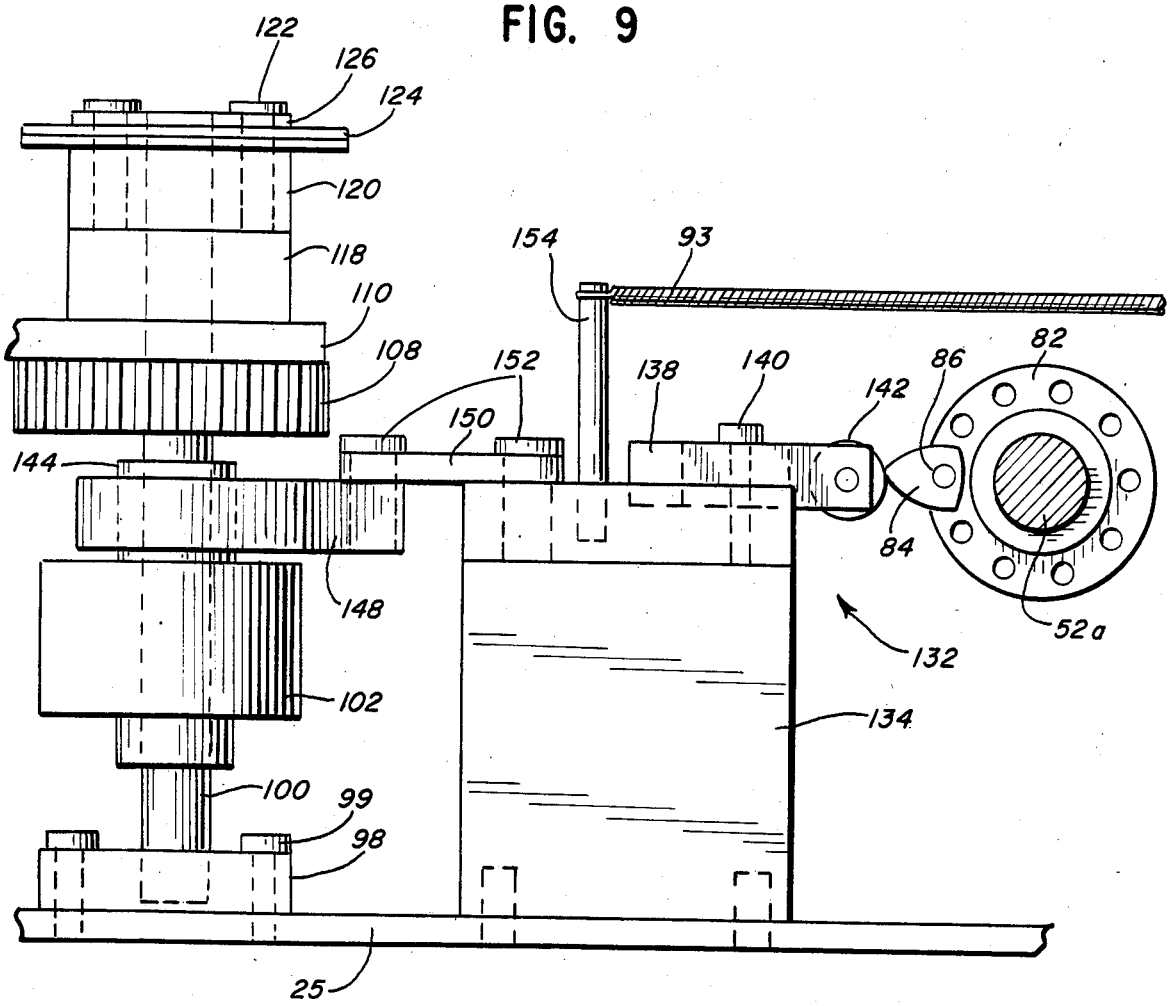
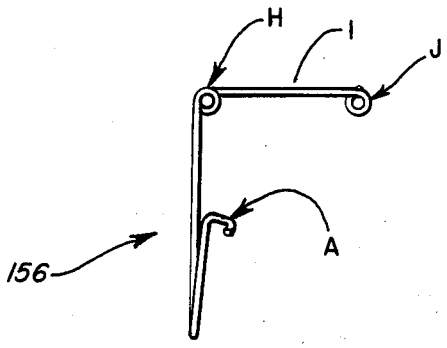
FIG. 10
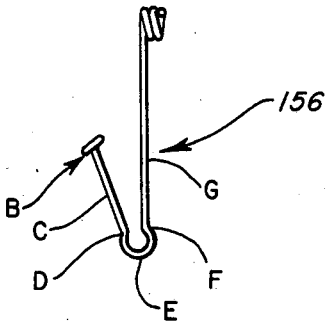
FIG. 11

CLUTCH APPARATUS FOR SPRING MAKING MACHINE

BACKGROUND OF THE INVENTION

This invention relates to wire forming and spring making machines, and more particularly to clutch apparatus for drivably operating such wire forming machines.

There have been numerous attempts in the past to provide wire forming machines having clutch devices for feeding the wire. Most such prior art devices had only a single clutch and used electrically or magnetically-operated mechanisms to directly drive, i.e., engage and disengage, the single feed drive clutch, such as a step-motor, for example. Other such prior art wire forming devices were computer-operated or paper tape-operated to provide impulse feeding of the wire to the forming slides. In the prior machines having only a single clutch, there inherently could not be any wire feeding during that portion of the operating cycle when the feed clutch was returning to its start-up position. Most prior wire forming devices were relatively expensive, required complex clutch mechanisms, and required expensive tooling to perform intricate wire forming operations. Additionally, many such devices were difficult to set up and required extensive operator training.

SUMMARY OF THE INVENTION

The present invention overcomes the disadvantages of the prior art wire forming machines by providing a wire forming machine having dual, independently-operable, oppositely-directed, one-way feed clutches which are driven by common gears. The present feed clutch drive system operates so that while one clutch is in its drive or feed mode, the other clutch is in its return mode, yet both clutches operate when in their respective driving modes to commonly drive both of the abutting wire feed rollers through connector gears. Accordingly, continuous feeding and forming of the wire is permitted since no down or return time, in effect, is required during a particular clutch's return mode. Stated another way, 360° of machine forming use is available with the present invention. This is contrary to the prior art single-clutch devices where only a maximum of 250° or less of machine forming time (i.e., rotation of the forming slide cams) was available for wire forming, with the remainder of rotation time devoted to the return of the feed drive clutch. In the preferred embodiment, separate cam-actuated rack gears are used to drive the dual one-way clutches. An alternative feed mechanism utilizing ball bearing slides, one-way bearings, and an eccentric lever connection to each drive clutch is also disclosed.

It is therefore a primary object of the present invention to provide an improved clutch system for a continuous wire forming machine, in which the clutch system utilizes dual, continuously-operating clutches which are driven off a common planetary drive gear and which are each operable, due to common connector gears, to drive both of the associated dual feed rollers.

It is another object of the present invention to provide a feed clutch system for a wire forming machine in which dual one-way clutches are driven by separate cam-actuated rack gears.

It is a further object of the present invention to provide a relatively inexpensive clutch system for a wire forming machine by providing continuous impulse feeding of the wire through commonly-connected mechanical drive means, without the necessity of electronic step-motor means or other complex impulse drive components, and which operates at a relatively high wire feed rate, i.e., running speed.

The means by which the foregoing and other objects of the present invention are accomplished and the manner of their accomplishment will be readily understood from the following specification upon reference to the accompanying drawings, in which:

FIG. 7 is an enlarged side elevation of the cam hub drive components of the present invention;

FIG. 8 is a plan view of an alternate form of the clutch drive apparatus for the present invention;

FIG. 9 is a side view of the alternate clutch drive apparatus;

FIG. 10 is a plan view of a sample wire spring formed by a spring making machine utilizing the present improved clutch apparatus; and FIG. 11 is a side view of the sample spring.

DESCRIPTION OF THE PREFERRED EMBODIMENT

Figure 2:
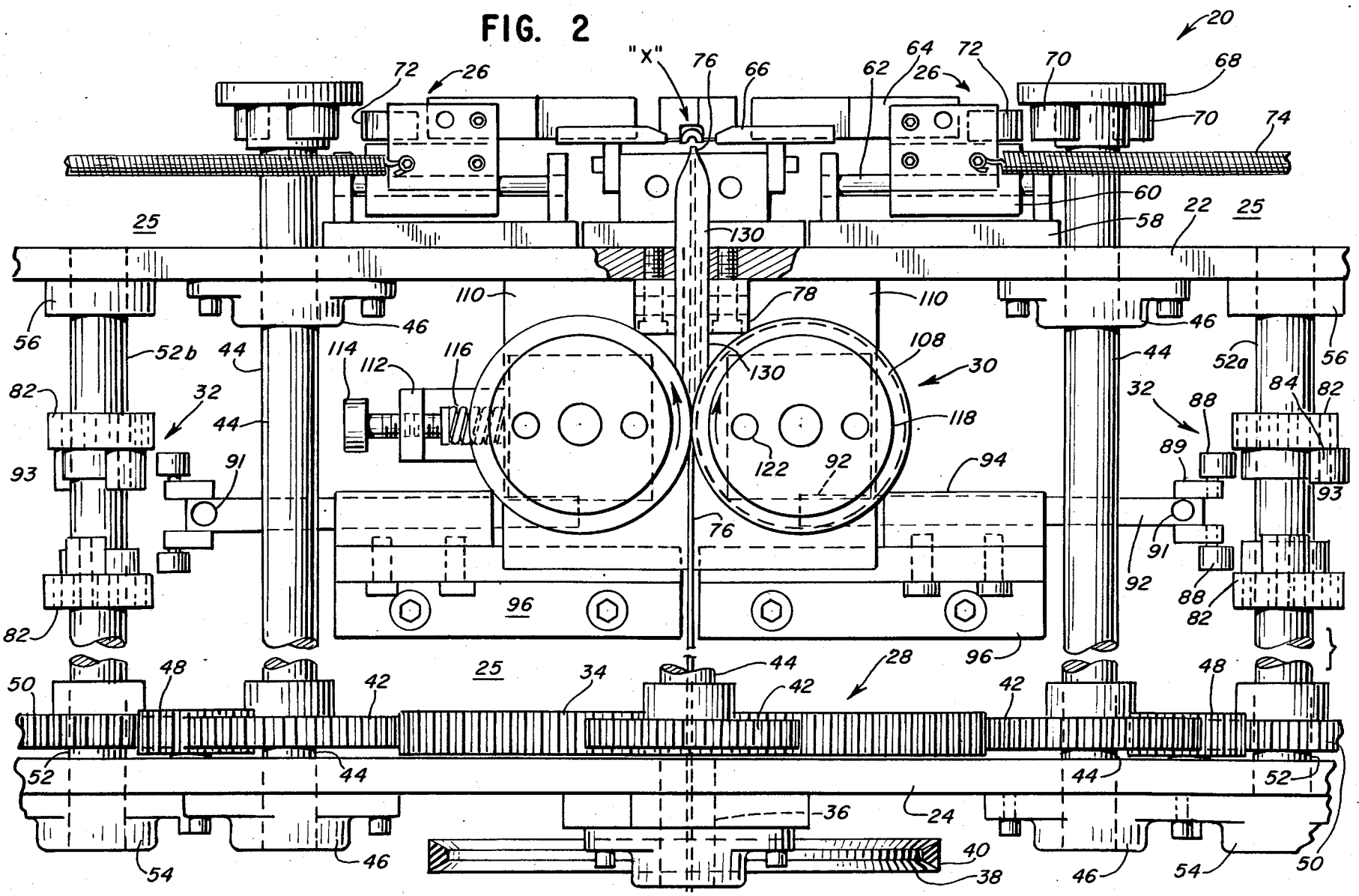
FIG. 2 is a top plan view of the present spring forming machine.
Figure 3:
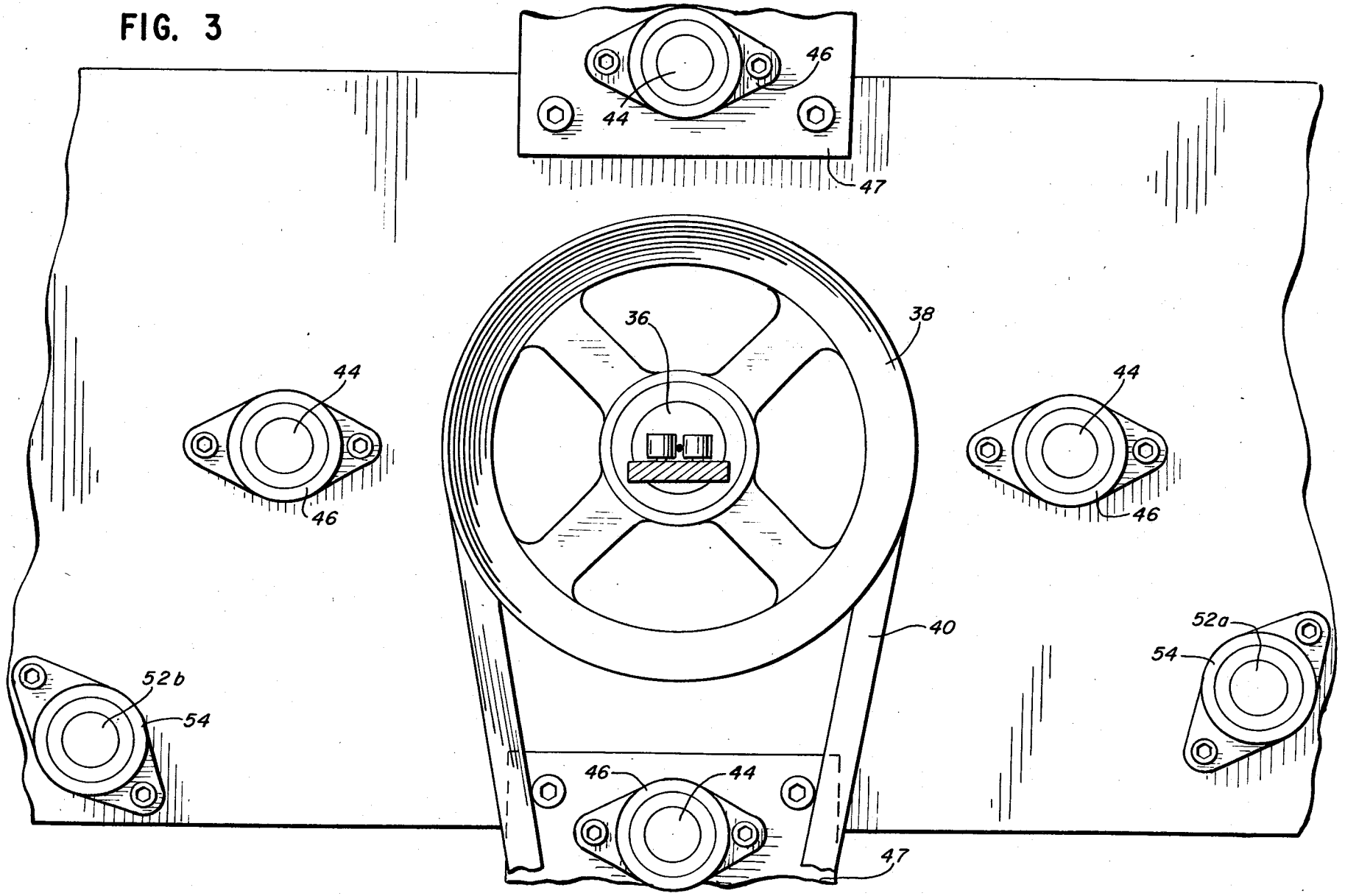
FIG. 3 is a rear elevation of the spring forming machine.
Figure 4:
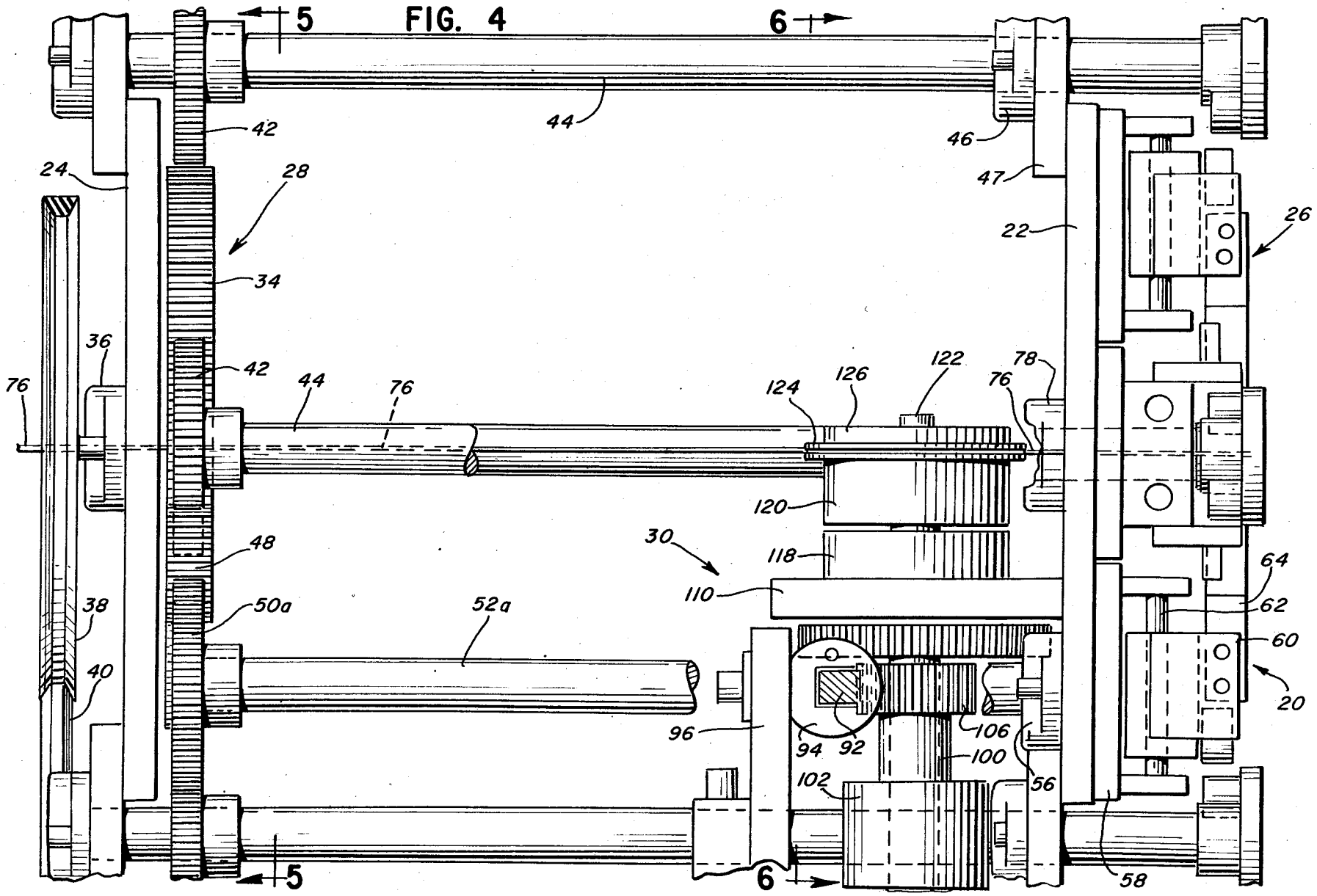
FIG. 4 is a left side elevation of the spring forming machine.

Having reference to the drawings, wherein like reference numerals indicate corresponding elements, there is shown in FIGS. 2 and 4 an illustration of a spring forming machine, generally denoted by reference numeral 20. Spring forming machine 20 comprises a faceplate 22 and a backplate 24 which are rigidly connected together in a horizontally-spaced relationship above a base plate 25 by at least four horizontally-aligned connector rods (not shown). Slideably mounted to the front of faceplate 22 are four slide plate assemblies 26. A planetary gearing assembly 28 is mounted adjacent the interior surface of the backplate 24. A dual feed drive clutch assembly, generally denoted by reference numeral 30, is mounted for operation proximate the interior surface of faceplate 22. A pair of drive cam hub assemblies 32 are mounted between the faceplate 22 and backplate 24 at opposite side locations of machine 20.

Figure 5:
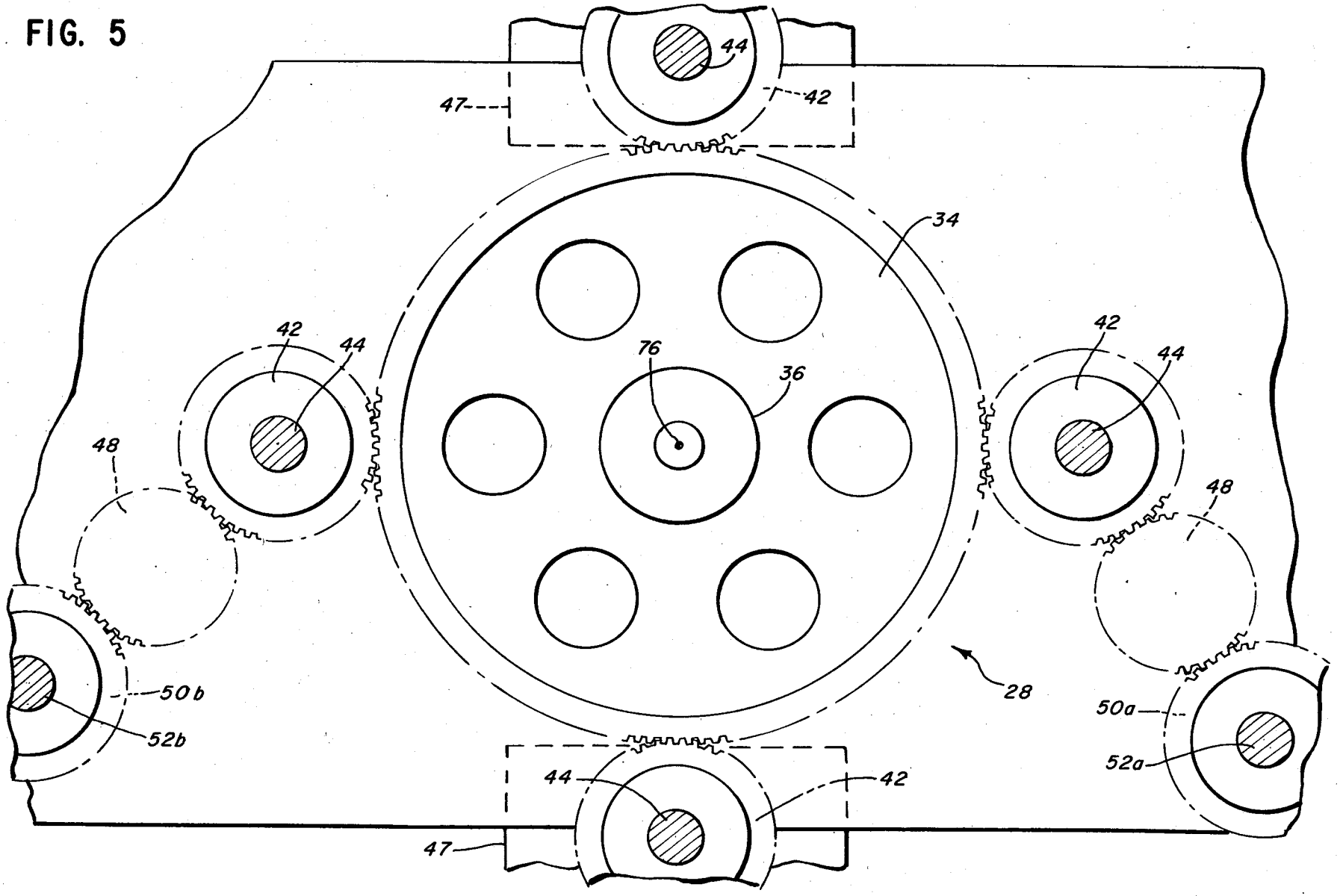
FIG. 5 is an elevation of the planetary gearing system for the present invention, as viewed along lines 5—5 of FIG. 4.

The plantary gearing assembly 28 includes a main drive gear 34 driven through a drive shaft hub 36 by a drive pulley 38 and drive belt 40, the latter drivably connected to a motor means (not shown). As shown in FIGS. 2 and 5, each of four slide movement gears 42 is meshed to the main drive gear 34 and is also securely mounted to one of four corresponding slide movement cam shafts 44. The cam shafts 44 are rotatably supported between the faceplate 22 and backplate 24 by journal bearings 46. The bearings 46 for the upper and lower cam shafts 44 are mounted on support plates 47 respectively carried by the main plates 22 and 24. Each cam shaft 44 projects through the front of faceplate 22. A pair of idler gears 48 are also rotatably mounted to backplate 24. A pair of feed movement gears 50 are secured to corresponding feed movement cam shafts 52; the cam shafts 52 are rotatably mounted to the backplate 24 by journal bearings 54 and to the faceplate 22 by bearing blocks 56.

Figure 1:
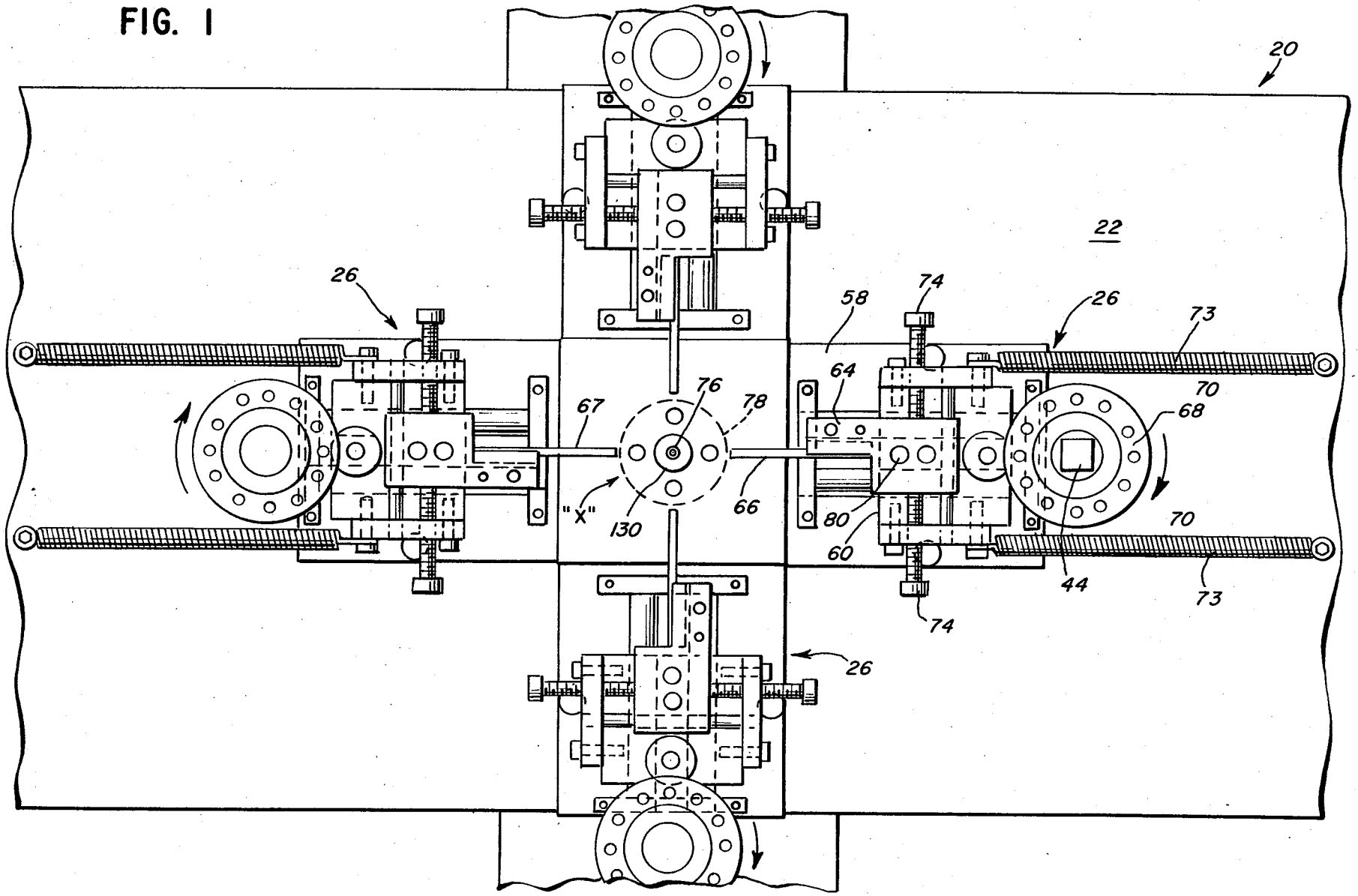
FIG. 1 is a front elevation view of the overall spring forming machine of the present invention.

Since each of the slide plate assemblies 26 are identical (but separately mounted for linear operation in each of four converging lines of movement as will be described), only one of such assemblies 26 will be described. As seen in FIG. 1, the linear motion of the right slide assembly 26 is from an extreme right position to an extreme inner or left position. That assembly 26 includes a mounting plate 58 affixed to faceplate 22 and a slide block 60 which is slidably carried on two guide rods 62. The slide block 60 carries a forming slide 64 to which is mounted a forming tool 66, in a well known fashion. A slide cam hub 68 is mounted on the outwardly extending end of each of the slide cam shafts 44. The hub 68 is formed so as to carry a plurality of selectively-positioned slide cam members 70, the number, configuration, and placement of which is determined by the various forming actions required for the associated forming tool 66.

Slide cam followers 72 are mounted on the slide block 60 and are repetitively engaged by the slide cam members 70 as the cam shaft 44 rotates. A pair of return springs 73 are each connected at their one end to the slide block 60 and at their other ends to the faceplate 22. The springs 73 normally bias the slide box 60 and the forming tool 66 carried thereby away from the wire forming area (indicated by "X" in FIGS. 1 and 2). It will be understood that each of the forming tools 66 can be variously configured, depending on the forming, bending, or cut-off operation required for a particular slide assembly 26. Also, the tools 66 can be separately activated towards the forming area "X" in any number of sequences in a well known manner, depending on the configuration and positioning of each of the cam members 70 on the slide cam hubs 68.

An adjustment knob 74 is provided to permit selective vertical adjustment of the slide block 60 and the forming tool 66 relative to the wire 76 as it comes through the quill 130. Additional adjusting fasteners 80 on the slide block 60 permit horizontal adjustment of the forming tool 66, i.e., adjustment in a direction inwardly and outwardly of the sheet of FIG. 1.

Figure 6:
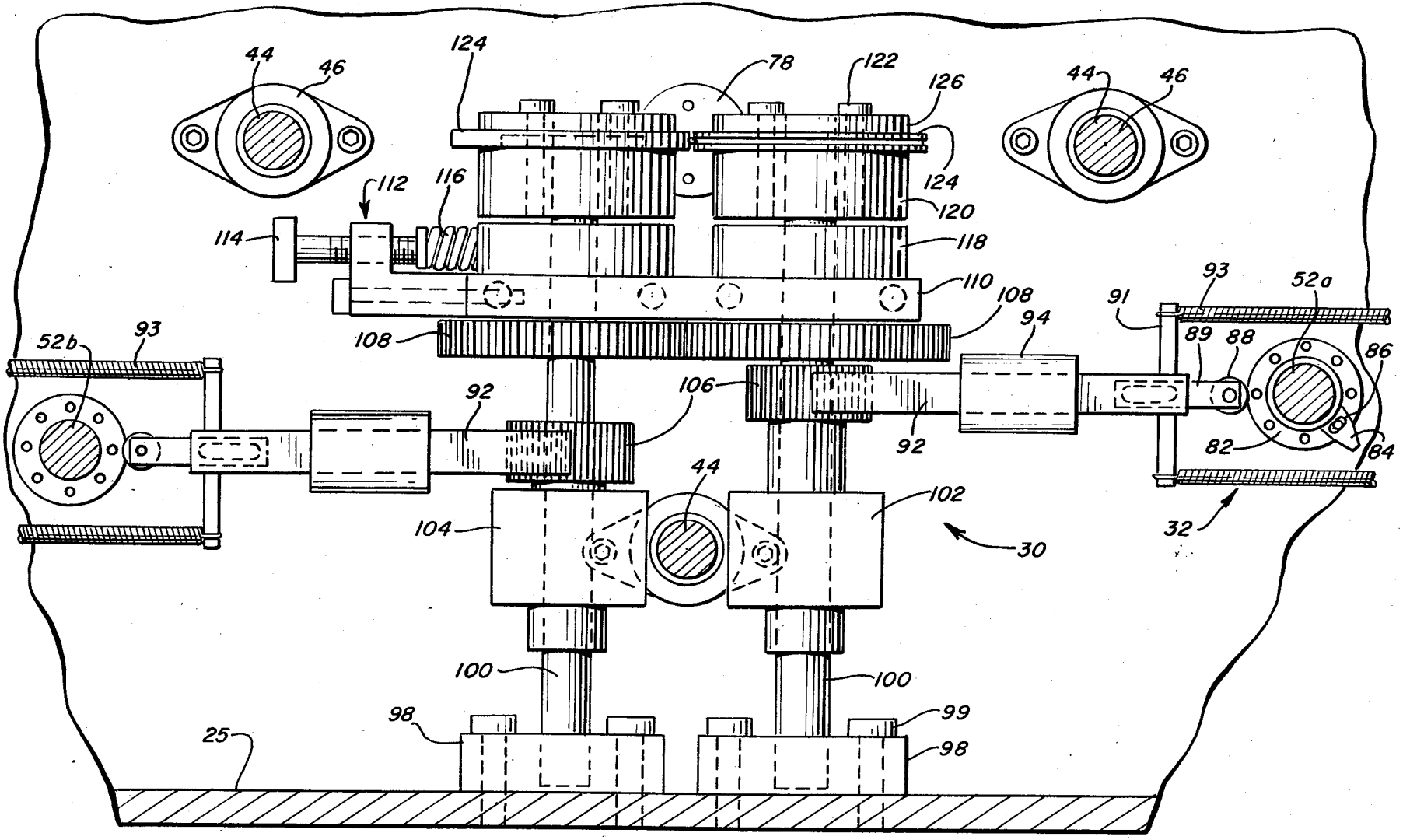
FIG. 6 is an enlarged elevation of the improved dual drive clutch system of the present invention, as viewed along lines 6—6 of FIG. 4.

As seen in FIGS. 2, 4 and 6, the right drive cam hub assembly 32 (only one of two being described since they are similar) includes two drive cam hubs 82 securely mounted to the drive cam shaft 52A. The hubs 82 (see FIG. 7) carry cam members 84 which are adjustably secured thereto by threaded fasteners 86. Due to rotation of the feed cam shafts 44, the cam members 84 drivably engage two cam rollers 88 which are carried by supports 89; the latter are adjustably fastened to the opposite sides one end of a rack gear 92. The rack gears 92 are journalled for linear movement (in a horizontal direction, see FIGS. 2 & 6) by a rack gear bushing 94 which is supported by angle brackets 96 and fasteners 97. The brackets 96 are fastened by suitable fasteners to the baseplate 25. A spring bracket 91 mounted to the roller end of the rack gear 92 carries two return or extension springs 93 which are secured at their other respective ends to the housing. The right return springs 93 normally bias the right rack gear 92 and roller 88 to the right (in FIG. 6) against the cam hub 82.

It will be understood that in the preferred embodiment, each drive cam hub 82 can conveniently carry four cam members 70, and since there are two cam hubs 82 for each of the two hub assemblies 32, as many as sixteen different wire feed movements can be provided to the wire 76.

As seen in FIGS. 2, 4 and 6, the dual drive clutch assembly 30 comprises two bearing housings 98 fastened to the baseplate 25 by threaded fasteners 99, two clutch shafts 100, a righthand one-way clutch 102, and a lefthand one-way clutch 104. It will be understood that each one-way clutch 102, 104 is operable to drivably coil in one direction, but freely rotate, i.e., return, in the other direction regardless of the movement of its clutch shaft 100. A feed gear 106 is mounted on each of the clutch shafts 100 at a point above the clutches 102, 104. Each of the feed gears 106 is meshed with the outer end of its associated rack gear 92. A pair of connector gears 108 are meshed to each other and are also mounted on each of the clutch shafts 100 above the feed gears 106 and below a support plate 110; the latter is carried by the faceplate 22. A feed roll tension adjusting mechanism 112, having an adjusting screw 114 and a tension spring 116, is carried at the left end (FIG. 2) of the support plate 110. Each clutch shaft 100 is rotatably mounted to a bearing housing 118 at a point above the support plate 110. A feed roll holder 120 is fastened by threaded fasteners 122 and supports the two opposing, i.e., abutting, wire feed rolls 124 with roll cover plates 126. It will be understood that adjustment of the feed roll tension adjusting mechanism 112 will cause (see FIGS. 2 and 6) the two wire feed rolls 124 to be pressed closer together towards the wire 78 or further apart depending on the adjustment made. The quill holder 78 is securely fastened to the faceplate 22 and rigidly holds a quill 130 through which the wire 78 is fed by the feed rolls 124.

There is shown in FIGS. 8 and 9 an alternate embodiment of the drive cam hub assemblies, generally denoted by reference numeral 132. (Reference numerals corresponding to similar components in the preferred embodiment will again be utilized for the alternate embodiment.) The modified drive cam hub assembly 132 comprises a slide base 134 upon which is slidably carried a ball bearing slide plate 136. A series of roller brackets 138 are adjustably secured by fasteners 140 to the top surface of the slide plate 136 and carry roller followers 142. A central hub 144 of the right hand clutch 102 is keyed via key 146 to an eccentric bracket 148. A connector link 150 is pivotally connected by a pair of pins 152 to both the eccentric bracket 148 and the slide plate 136. A spring support post 154 secures the return spring 93 to plate 136. It will be understood that, while the bracket 148 will only reciprocate about shaft 100, the slide plate 136, due to its eccentric connection to the slide base 134, will reciprocate in a linear fashion (see the respective directional arrows shown in FIG. 8.

I turn now to an operational description of the subject invention, particularly with reference to the set-up procedures for the spring forming machine 20 with reference to producing a typical spring 156 (see FIGS. 10 and 11). As seen in those Figures, the spring 156 contains certain curved, hooked, and straight portions, to be described. That is, the various spring segments labelled by reference letters A–J each require a specific and distinct forming movement and/or feed movement by the machine 20.

More specifically, as is well-known, an appropriately-designed cam member 84 is selected to produce the required length for spring section A. That cam member 84 is bolted onto the upper right hand cam hub 82 (see FIG. 2), and the formed length of portion A is adjusted by adjusting the position of the associated cam roller 88. Similarly, so as to form the desired radius for spring portion A, an appropriate slide cam member 70 is fastened to the slide cam hub 68 which controls the left hand horizontal slide (FIG. 1). The forming tool 67 is adjusted to form the proper radius in spring portion A, and the movement of tool 67 is timed with the feed movement of wire 76 and the movement of the opposing forming tool 67.

Another appropriately-designed cam member 70, for forming the 90° bend in spring portion B, is also fastened to slide cam hub 68, and the bottom vertical slide assembly 26 is adjusted. Another feed cam member 84, for forming the required length of spring portion C, is bolted to the upper left hand cam hub 82 (FIG. 2). The formed length of portion C is adjusted by adjusting the location of the related cam follower 88. Another forming cam 70 is used to form the back bend in spring portion D; that cam 70 is also fastened to slide cam hub 68 for the upper vertical slide assembly 26. The associated forming tool is adjusted for the proper angle of the back bend at spring portion D.

Another feed cam member 84 is selected for forming the radius coiling of spring portion E; that cam 84 is secured to the lower right hand feed cam hub 82. The cam rollers 88 are adjusted for the proper length of the formed radius coil end portion E. Additionally, in connection with radius portion E, an appropriate forming cam 70 is selected and bolted to the slide cam hub 68 which operates the lower vertical slide assembly 26. The forming tool on that slide assembly is adjusted for proper radius of portion E, and the tool movement is timed with the related wire feed movement.

For forming the spring portion F which includes a back bend, an appropriate forming cam member 70 is bolted to the slide cam of 68 which operates the upper vertical slide assembly 26. The related forming tool for that slide assembly is adjusted for the proper back bend angle of spring portion F. Also, a feed cam member 84 is selected for the appropriate wire length for spring portion G; that cam is bolted to the lower left hand feed cam hub 82 (FIG. 2). Again, the length of the wire portion G is adjusted by adjusting the location of the associated follower roller 88.

A feed cam member 84 is then selected for the length of the diameter of the coil portion H; that cam 84 is bolted to the upper right hand feed cam hub 82. Further, a forming cam member 70 is selected to form the diameter of the portion H and bolted to the slide cam hub 68 which operates the left hand horizontal slide assembly 26 (see FIG. 1). The associated forming tool 67 is adjusted to properly form the diameter of the coil spring portion H; the tool movement is timed with the related feed movement by making suitable roller follower adjustments.

An appropriate feed cam 84 is selected to form the length of the straight wire portion I and is bolted to the upper left hand feed cam hub 82. Then, a forming cam member 70 for forming the length of the diameter of the coiled end portion J is fastened to the lower right hand feed cam hub 82. Also, in connection with forming the diameter of the coiled portion J, an appropriate forming cam member 70 is bolted to the slide cam hub 68 which drives the left hand horizontal slide assembly 26. As before, tool movement is timed in connection with the feed movement, and the related forming tool is adjusted to form the desired diameter of the coiled portion J. Finally, an appropriate cam member 84 is selected to operate the cut-off tool associated with the right hand horizontal slide assembly 26; that cam 84 is fastened to the appropriate feed cam hub 82.

It will be seen that by the appropriate selection, in a well known manner, of the various feed cams 84 and forming cams 70, and by appropriate placement thereof on the various cam hubs 68, 82, each of the various portions A–J of spring 156 can be readily formed through use of the present invention. Spring forming operations thus can be accomplished in a relatively inexpensive manner, from the standpoint of initial purchase price, as well as minimal operator time required for set-up and adjustment procedures before commencing spring production. Further, the present invention's preferred embodiment operates at a substantially increased operating speed over conventional types of spring forming machines, including computer-operated machines. That is because there are no step motors present which must consecutively start and stop during torming operations.

The foregoing advantages primarily occur because, regardless of whether the preferred embodiment 32 or the alternate embodiment 132 of the drive cam hub assembly is utilized, each of the right hand and left hand feed drive clutches 102, 104 is positively driven in a feed direction, and returned in the freely rotational direction, by the drive cam hub assemblies. Further, since each of the respective drive clutches 102, 104, are one-way type clutches, the common connection of the two clutch shafts 100 by connecting gears 108 permits such gears, regardless of which specific clutch is driving the gears 108 at any one time, to continuously drive both wire feed rolls 124. That is, regardless of which drive clutch is in its driving mode and thereby drivably coiling the associated clutch shaft 100 at a given instance, the other clutch, since it is in its return mode and is freely rotating, does not, in effect, see the rotational movement placed on its associated clutch shaft 100 by the connecting gears 108. Thus, the present invention's advantageous use of dual, one-way (i.e., right hand and left hand) drive clutches, in conjunction with common connecting gears, provides a continuous driving of the abutting wire feed rolls, by which a continuous feeding of the wire is achieved.

Further, the present invention's use of dual, one-way clutches combined with common connecting gears permits 360° of machine use; this is due to the continuous feeding thus provided. That is, when one of the slide cam hubs has rotated an entire 360°, there has been a complete forming cycle of the present wire forming machine. Similarly, when one of the feed cam hubs has proceeded through an entire revolution, there has been a complete forming cycle of the present spring forming machine.

The present invention also requires minimal set-up time, due to the open and accessible interior area of the machine 20 as provided by the specific configuration of the feed drive clutch assemblies. It is relatively easy to change cam members on the feed and forming cam hubs and to adjust the associated cam rollers.

From the foregoing, it is believed that those skilled in the art will readily appreciate the unique features and advantages of the present invention over previous types of drive clutch mechanisms for wire forming equipment. Further, it is to be understood that while the present invention has been described in relation to a particular preferred embodiment, as well as an alternate embodiment, as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

I claim:

1. A motor-driven wire forming machine having a housing supporting a plurality of forming slides for forming a wire into a selected shape, the improvement comprising:

a main drive gear driven by the motor and driving a planetary gearing means;

wire feed roll means operable to drivably feed the wire to the forming slides;

a plurality of feed drive clutch means for providing continuous driving of said wire feed roll means;

cam means driven by said planetary gearing means for driving said feed drive clutch means; and connector drive means interconnecting said feed drive clutch means with said wire feed roll means, said connector drive means selectively driven by at least one of said plurality of feed drive clutch means and operable to continuously drive said wire feed roll means regardless of which said feed drive clutch means is in a driving condition at any given time.

2. The invention of claim 1, wherein said plurality of feed drive clutch means includes at least two, one-way drive clutches respectively carried by shaft means, each said one-way drive clutch operable to drivably coil in one direction, yet freely rotate in the opposite direction regardless of the direction of rotation of the associated shaft means.

3. The invention of claim 1, wherein said cam means comprises cam-actuated gear means drivably connected to said feed drive clutch means.

4. The invention of claim 3, wherein said cam-actuated gear means comprises cam-driven rack gear means.

5. The invention of claim 1, wherein said cam means comprises cam-actuated slide means drivably interconnected to said feed drive clutch means.

6. The invention of claim 1, wherein said connector drive means comprises meshed connector gears, one said connector gear mounted for rotation with each of said plurality of feed drive clutch means when the same is in a driving condition.

7. An improved wire feed drive apparatus for a wire forming machine having at least one forming slide, the apparatus comprising:

two feed rolls mounted in abutting relation and jointly operable, when drivably rotated, to feed wire to the forming slide;

a pair of separately-operable feed drive clutches, each said clutch operable to provide feed drive motion to said feed rolls, yet operable to freely rotate in a return motion without affecting the continued driving of said feed rolls by the other said feed drive clutch;

cam-actuated drive means drivably interconnected to said feed drive clutches for selectively driving and returning the same; and connector drive means drivably interconnected to both said feed rolls and to said pair of feed drive clutches, said connector drive means operable to simultaneously drive both said feed rolls regardless of which said feed drive clutch is in its driving mode at any given time, whereby continuous wire feeding is provided for the wire forming machine.

8. The invention of claim 7, wherein said cam-actuated drive means comprises cam-driven rack gear means for providing both feed drive motion and return motion to said feed drive clutches.

* * * * *